US005974719A

United States Patent [19]

Simonek

[11] Patent Number: 5,974,719

[45] Date of Patent: Nov. 2, 1999

[54] GUN SUPPORT

[76] Inventor: Edward L. Simonek, 2440 N. Beckley, Lancaster, Tex. 75134

[21] Appl. No.: 09/128,110

[22] Filed: Aug. 3, 1998

[51] Int. Cl.[6] ..... F41A 3/64

[52] U.S. Cl. ..... 42/94; 211/94

[58] Field of Search ..... 42/94; 211/94

[56] References Cited

U.S. PATENT DOCUMENTS

| | | | |
|---|---|---|---|
| 759,593 | 5/1904 | Cover | 42/94 |
| 1,324,934 | 12/1919 | Shand | 42/94 |
| 2,870,683 | 1/1959 | Wilson | 89/40 |
| 3,225,656 | 12/1965 | Flaherty et al. | 42/94 |
| 3,313,505 | 4/1967 | Petrie | 248/165 |
| 3,703,046 | 11/1972 | Barone et al. | 42/94 |
| 4,007,554 | 2/1977 | Helmstandter | 42/94 |
| 4,058,221 | 11/1977 | Elkins et al. | 211/87 |
| 4,648,516 | 3/1987 | Elkins | 211/64 |
| 5,402,595 | 4/1995 | Tamilos | 42/94 |
| 5,421,115 | 6/1995 | McKay | 42/94 |
| 5,438,786 | 8/1995 | Hilderbrand | 42/94 |
| 5,644,862 | 7/1997 | Folmer . | |
| 5,666,757 | 9/1997 | Helmstadter . | |

*Primary Examiner*—Charles T. Jordan
*Assistant Examiner*—Meena Chelliah
*Attorney, Agent, or Firm*—H. Dennis Kelly; Jeffrey T. Hubbard; Timmons & Kelly

[57] ABSTRACT

A gun support has an elongated vertical support member attached to a tripod base and a gun support member attached to the vertical support rod. The vertical support member attaches to the tripod base via a swivel plate that enables the vertical support member to be turned through a 360 degree range. Means for tilting the vertical support member within a preselected range are provided by a retaining box fixed to the swivel plate, the vertical support member being pivotally attached to the retaining box with a bolt.

13 Claims, 2 Drawing Sheets

GUN SUPPORT

BACKGROUND OF THE INVENTION

1. Field of the Invention

This invention relates in general to gun supports. In particular, the invention relates to an improved, lightweight, all-weather gun support, designed for use on uneven, and sloping terrain as well as hard flat level surfaces, and that allows the gun and support to be tilted and turned during shooting, while allowing fixed adjustment for gun height and elevation.

2. Description of the Related Art

Shooting enthusiasts and hunters have long recognized a need for devices that can support the weight of their firearm for extended periods of time, yet still give them the ability to shoot with extreme accuracy. Many devices have been devised to address this need, and numerous schemes have been employed that provide useful features.

U.S. Pat. No. 5,666,757, issued to Helmstadter on Sep. 16, 1997, discloses a gun shooting rest that employs a single vertical rod having a pointed foot that is inserted into the ground using a foot stand-on bracket welded onto the bottom part of the rod. A gun rest attaches to a collar that can be locked in place along the rod in order to adjust the height of the gun rest. The structure is not designed for use on hard or paved surfaces, and adjustment of the elevation of the gun barrel requires loosening a holding nut, adjusting the gun rest, and retightening the holding nut.

U.S. Pat. No. 5,644,862, issued to Folmer on Jul. 8, 1997, discloses an adjustable made up of two parallel panels, shaped like right triangles and mounted on a base. A gun rest attaches to the panels with a bolt and wingnut. The bolt travels in a slot running along the hypotenuse of the right-triangles. Height is adjusted by varying the position of the gun rest in the slots. The structure is cumbersome, and requires the user to balance the gun on the gun rest, which makes one-handed shooting difficult.

SUMMARY OF THE INVENTION

The general object of the invention is to support and steady a gun having a long barrel. Another object, concurrent with the main object, is to allow changes in the elevation and direction of the gun simply by redirecting the gun, without the need for disengaging a clamp or similar device for holding the support in a particular position. A third object of the invention is to provide stable support for a gun on various surfaces, from level paved areas to uneven and gently sloping terrain. Still another object is that the whole structure be capable of being collapsed into a compact assembly when not in use. A final object is that the device be simple to make and use, and be rugged, lightweight, and inexpensive.

In general, these objects are achieved by the combination of a tripod base having three legs pivotally attached to a base plate, a vertical support member, and at least one gun support member attached to the vertical support member and adapted to hold a gun for shooting. The legs are extended away from each other during use, and can be drawn together to occupy less space for storage.

A swivel plate fastened to the base plate enables the gun support member to be turned through a 360 degree range for aiming the gun during use. The vertical support member fits into a retaining box affixed to the swivel plate. The vertical support member is pivotally attached to the retaining box so that the vertical support member can be tilted through a preselected angular range about an tripod axis perpendicular to the swivel plate. Frictional contact between the vertical support member and the retaining box holds the vertical support member in place. The gun supports are designed to attach to the vertical support member at a number of locations along the length of the vertical support member in order to adjust the height of the gun support members.

The above objects, as well as additional objects, features, and advantages of the invention will become apparent in the following detailed description and in the drawings.

DESCRIPTION OF THE PREFERRED EMBODIMENT

Figure 1:
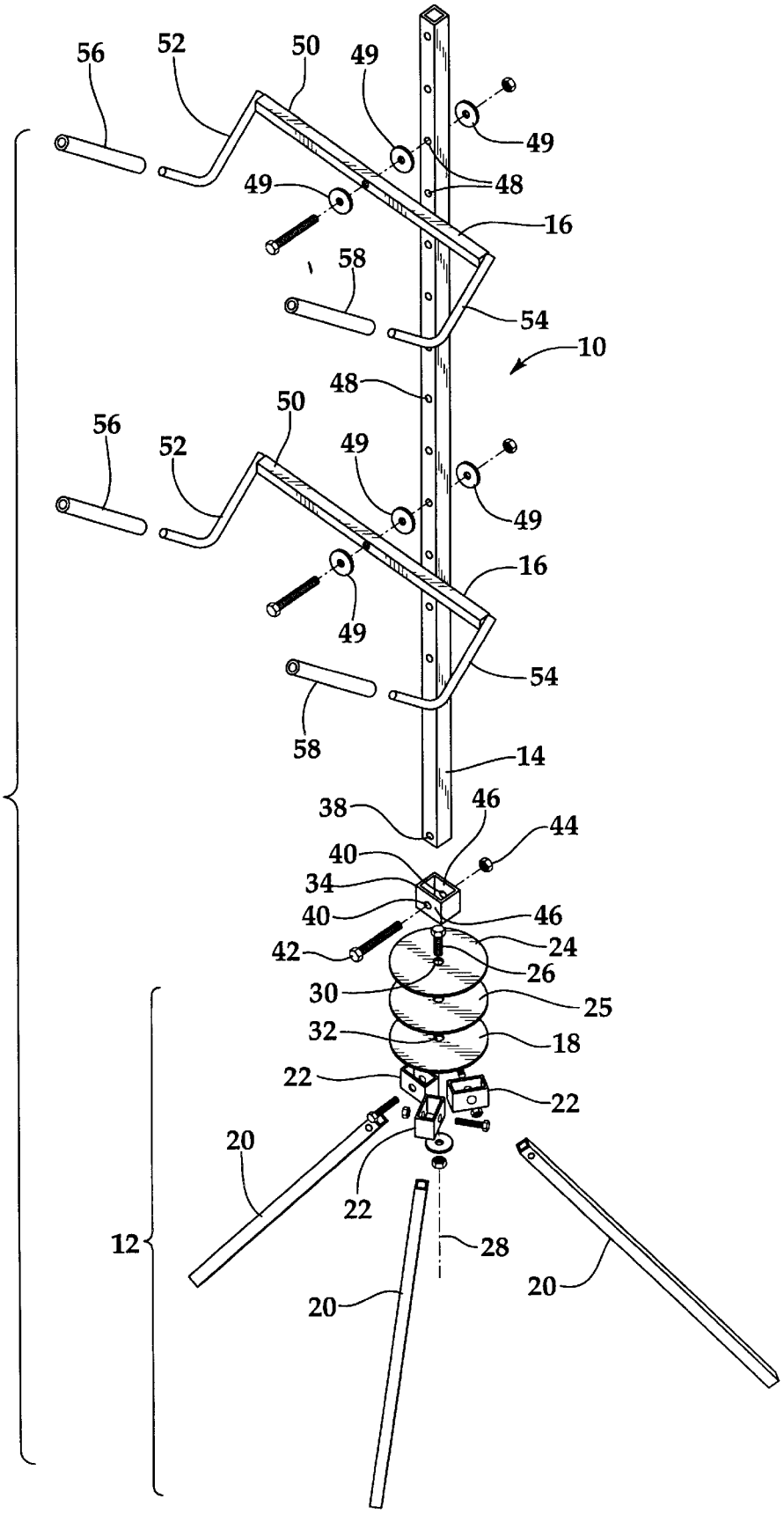
FIG. 1 is an exploded perspective view of a gun support according to the invention.
Figures 2, 3:
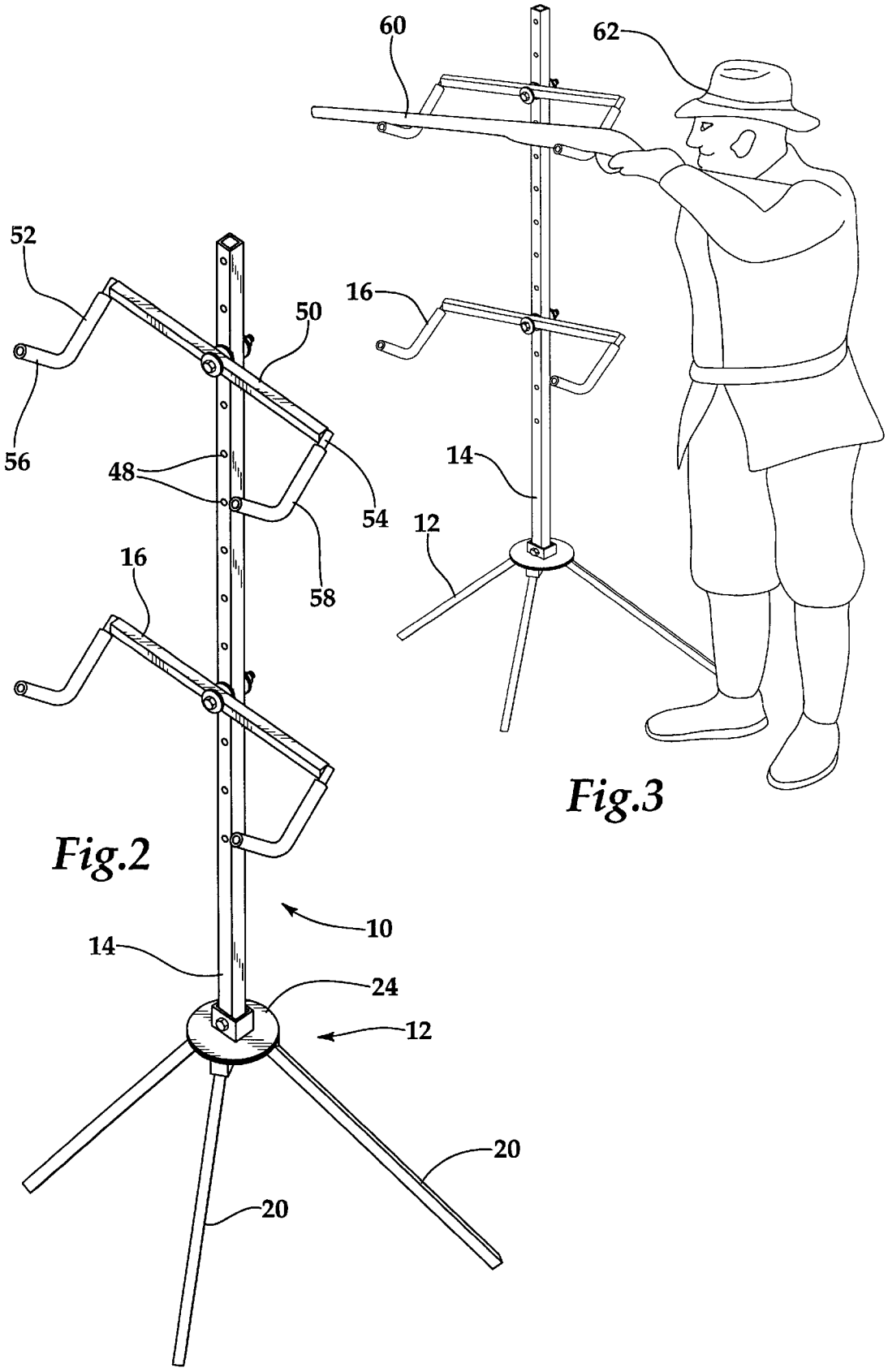
FIG. 2 is another perspective view thereof, showing the gun support when fully assembled.
FIG. 3 is a perspective view of the gun support in use.

As shown in FIGS. 1 and 2, the preferred embodiment of the gun support 10 has a tripod base 12, a vertical support member 14 made from square aluminum tubing, and two identical gun brackets 16. The tripod base 12 is made up of three identical legs 20 made from square aluminum tubing, pivotally attached to a base plate 18 via three leg holders 22 welded to the bottom of the base plate 18. The legs 20 can be folded up when the gun support 10 is not in use in order to occupy a smaller space for storage. The leg holders 22 are designed to act as stops for the legs 20 to hold each leg 20 at a preselected angle relative to the base plate 18 when the legs 20 are extended outward and away from each other.

A swivel plate 24 is fastened to the base plate 18 with a bolt 26 that passes through holes 30 and 32 located in the respective centers of the swivel plate 24 and the base plate 18. The swivel plate 24 provides means for turning the vertical support member 14 about a tripod axis 28 that is perpendicular to the swivel plate 24 and coincident with the longitudinal axis 28 of the bolt 26.

Friction between the swivel plate 24 and the base plate 18 can cause the turning action to be jerky and uneven. A washer 25 made of a low-friction material, such as UHMW or PTFE plastic, is used between the swivel plate 24 and the base plate 18 to reduce friction, resulting in smooth and steady motion. Other means known in the art for reducing the friction of contact can also be used.

A rectangular retaining box 34 is welded to the top side of the swivel plate 24 and provides means for tilting the vertical support member 14. The smaller inside dimension of the retaining box 26 is sized to create a snug fit when the bottom end 36 of the vertical support member 14 is inserted in the retaining box 26. Holes 38 located in opposite sides of the vertical support member 14 are designed to align with holes 40 located in opposite sides of the retaining box 34. With the holes 38 and 40 aligned, a bolt 42 is passed through the holes 38 and 40 and secured with a locknut 44 to hold the vertical support member 14 and the retaining box 26 together. The larger inside dimension of the box 26 is selected to permit the vertical support member 14 to be pivoted manually about the bolt 42 over a preselected range. The walls of the retaining box 34 act as stops to prevent tilting of the vertical support member 14 outside the preselected range.

As the locknut 44 is tightened on the bolt 42, the longer walls 46 of the retaining box 34 are biased inwardly against the bottom end 36 of the vertical support member 14. When the locknut is properly tightened, static friction between the walls 46 and the vertical support member 14 will enable the vertical support member 14 to remain in place at any position within the preselected range until the user changes the position by hand. Care should be taken not to overtighten the locknut 44 to avoid crushing the retaining box 34 and the bottom end 36 of the vertical support member 14. Other means known in the art can also be used for providing a non-locking frictional contact that will hold the vertical support member 14 in place.

Two identical gun brackets 16 are attached to the vertical support member 14 at typical heights for firing a gun from standing and kneeling positions. Holes 48 are located at regular intervals along the length of the vertical support member 14 for attaching a gun bracket 16 to the vertical support member 14 with a bolt and nut. Identical nylon washers 49 are used to prevent metal-to-metal contact in attaching the gun bracket 16 to the vertical support member 14. This allows the gun bracket 16 to pivot smoothly on the vertical support member 14. This provides another means for adjusting the elevation of the gun bracket 16. The height of each gun bracket 16 is adjusted by using a different hole 48 in the vertical support member 14 to attach the gun bracket 16.

Each gun bracket 16 has an elongated main beam 50 made of aluminum tubing, a barrel support 52 welded to one end of the main beam 50, and a stock support 54 welded to the other end of the main beam 50. The barrel support 52 and the stock support 54 support a gun (reference 60 in FIG. 3) for shooting. Cushions 56 and 58 made of a soft pliable material such as are cloth, rubber, or leather are placed over the barrel support 52 and the stock support 54, to prevent scratching and to cushion and stabilize the barrel or stock of the gun 60 that is placed in the gun support 10.

Turning to FIG. 3, the gun support 10 is shown in use with a gun 60 held in the gun bracket 16 at shoulder height for shooting from a standing position. Several advantages of the claimed invention are obvious from the figure. First, the gun support 10 allows the user 62 to aim and shoot the gun 60 using only one hand. The tripod base 12 ensures secure footing of the gun support 10 whether the ground is flat and even, as for example when standing on a concrete or paved surface, or sloping and uneven, such as when using the gun support 10 for hunting. Even though the gun bracket 16 is fixed to the vertical support member 14, minor adjustment for barrel elevation can be made during aiming simply by tilting the vertical support member 14. This feature also allows the user 62 to keep the vertical support member 14 substantially vertical when the tripod base 12 is standing on a non-level surface. The swivel plate 24 allows the gun bracket 16 to be turned through a 360 degree range for aiming without the need for locking and unlocking a clamp.

The invention have been shown in only one embodiment. It should be apparent to those skilled in the art that the invention is no limited to the embodiment, but is capable of being varied and modified without departing from the scope of the invention as set out in the attached claims.

What is claimed is:

1. A support for use with a rifle or shotgun, comprising:

a tripod base;

an elongated vertical support member;

swiveling means, interconnecting the tripod base and the vertical support member, for allowing the vertical support member to rotate about a tripod axis passing through the tripod base;

a connector having a longitudinal axis;

a rectangular box fixed to the swiveling means, the box being sized to receive a bottom end of the vertical support member and to allow unidirectional movement of the support member, the support member being connected to the box by the connector in a manner allowing the support member to pivot within the box about the longitudinal axis of the connector; and at least one gun support member capable of being attached to the vertical support member at one of a number of points located along the length of the vertical support member.

2. A gun support as recited in claim 1, wherein the tripod base further comprises three legs and a base plate.

3. A gun support as recited in claim 1, wherein the swiveling means comprises a disc-shaped swivel plate and a fastener having a longitudinal axis, the swivel plate being attached to the tripod base with the fastener, the swivel plate being capable of turning about the longitudinal axis of the fastener.

4. A gun support as recited in claim 1, wherein the gun support member further comprises a main beam, a barrel support fixed to one end of the main beam, and a stock support fixed to the other end of the main beam.

5. A gun support as recited in claim 1, wherein the gun support member further comprises a main beam, a barrel support fixed to one end of the main beam, and a stock support fixed to the other end of the main beam.

6. A support for use with a rifle or shotgun, comprising:

a tripod base having three legs and a base plate;

an elongated vertical support member;

a disc-shaped swivel plate attached to the base plate with a fastener having a longitudinal axis, the swivel plate being capable of turning about the longitudinal axis of the fastener;

a connector having a longitudinal axis;

a rectangular box fixed to the swiveling means, the box being sized to receive a bottom end of the vertical support member and to allow unidirectional movement of the support member, the support member being connected to the box by the connector in a manner allowing the support member to pivot within the box about the longitudinal axis of the connector; and at least one gun support member capable of being attached to the vertical support member at one of a number of points located along the length of the vertical support member.

7. A gun support as recited in claim 6, wherein the gun support ember further comprises a main beam, a barrel support fixed to one end of the main beam, and a stock support fixed to the other end of the main beam.

8. A gun support as recited in claim 6, wherein the gun support member further comprises a main beam, a barrel support fixed to one end of the main beam, and a stock support fixed to the other end of the main beam.

9. A support for use with a rifle or shotgun, comprising:

a tripod base;

an elongated vertical support member;

swiveling means, interconnecting the tripod base and the vertical support member, for allowing the vertical support member to rotate about a tripod axis passing through the tripod base;

tilting means, interconnecting the swiveling means and a bottom end of the vertical support member, for allowing the vertical support member to be tilted about a pivot within a preselected range through a plane containing the tripod axis, and for holding the vertical support member in place at any position within the preselected range without the need to lock or clamp the vertical support member in place; and at least one gun support member capable of being attached to the vertical support member at one of a number of points located along the length of the vertical support member.

10. A gun support as recited in claim 9, wherein the tripod base further comprises three legs and a base plate.

11. A gun support as recited in claim 9, wherein the swiveling means comprises a disc-shaped swivel plate and a fastener having a longitudinal axis, the swivel plate being attached to the tripod base with the fastener, the swivel plate being capable of turning about the longitudinal axis of the fastener.

12. A gun support as recited in claim 9, wherein the tilting means comprises a connector having a longitudinal axis and a rectangular box fixed to the swiveling means, the box being sized to receive a bottom end of the vertical support member and to allow unidirectional movement of the support member, the support member being connected to the box by the connector in a manner allowing the support member to pivot within the box about the longitudinal axis of the connector.

13. A gun support as recited in claim 9, wherein the gun support member further comprises a main beam, a barrel support fixed to one end of the main beam, and a stock support fixed to the other end of the main beam.

* * * * *